US010737917B2

(12) United States Patent
Paal et al.

(10) Patent No.: US 10,737,917 B2
(45) Date of Patent: Aug. 11, 2020

(54) HOISTING WINCH ASSEMBLY

(71) Applicant: Liebherr-Components Biberach GmbH, Biberach an der Riss (DE)

(72) Inventors: Martin Paal, Biberach (DE); Steven Kreyssig, Hochdorf (DE); Johannes Bulling, Bad Waldsee (DE)

(73) Assignee: Liebherr-Components Biberach GmbH, Biberach an der Riß (DE)

( * ) Notice: Subject to any disclaimer, the term of this patent is extended or adjusted under 35 U.S.C. 154(b) by 147 days.

(21) Appl. No.: 15/860,505

(22) Filed: Jan. 2, 2018

(65) Prior Publication Data

US 2018/0141790 A1 May 24, 2018

Related U.S. Application Data

(63) Continuation of application No. PCT/EP2016/001060, filed on Jun. 22, 2016.

(30) Foreign Application Priority Data

Jul. 3, 2015 (DE) ..... 20 2015 004 788 U
Aug. 28, 2015 (DE) ..... 20 2015 006 083 U

(51) Int. Cl.
*B66D 1/26* (2006.01)
*B66D 1/14* (2006.01)
(Continued)

(52) U.S. Cl.
CPC ..... *B66D 1/26* (2013.01); *B66C 19/007* (2013.01); *B66D 1/12* (2013.01); *B66D 1/14* (2013.01)

(58) Field of Classification Search
CPC .... B66D 1/26; B66D 1/12; B66D 1/14; B66C 19/007
See application file for complete search history.

(56) References Cited

U.S. PATENT DOCUMENTS 1,315,124 A 9/1919 Fischer et al.
2,271,427 A 1/1942 Harry
(Continued)

FOREIGN PATENT DOCUMENTS

AT 202734 4/1959
CN 102398869 9/2013
(Continued)

*Primary Examiner* — Sang K Kim
*Assistant Examiner* — Nathaniel L Adams
(74) *Attorney, Agent, or Firm* — Levine Bagade Han LLP

(57) ABSTRACT

The present invention relates to a hoisting winch assembly comprising at least two preferably axially parallel drums spaced from each other axially, which can be driven in synchronism with each other by two motors via a transmission assembly. The invention furthermore relates to a crane, in particular a gantry and/or container crane, with such hoisting winch assembly. According to the invention, the transmission assembly has at least two separate gear trains, so that each motor is in drive connection with one drum each via a separate gear train. As compared to a common transmission to which both motors are connected, the separate gear trains can be configured significantly lighter and smaller, as no longer the power of both motors added up, but only the power of one motor must be transmitted. Nevertheless, high hoisting powers can be provided on the whole, as each motor must drive only one drum.

19 Claims, 4 Drawing Sheets

(51) Int. Cl.
*B66C 19/00* (2006.01)
*B66D 1/12* (2006.01)

(56) References Cited

U.S. PATENT DOCUMENTS

| | | | | |
|---|---|---|---|---|
| 2,370,834 | A | 3/1945 | Ball | |
| 3,770,136 | A | 11/1973 | Fischer | |
| 7,896,315 | B2 * | 3/2011 | Faust | B66D 1/26 254/275 |

FOREIGN PATENT DOCUMENTS

| | | |
|---|---|---|
| CN | 203373047 | 1/2014 |
| CN | 103982598 | 8/2014 |
| CN | 204138246 | 2/2015 |
| DE | 1800787 | 11/1959 |
| DE | 1202454 | 10/1965 |
| DE | 1273158 | 7/1968 |
| DE | 108718 | 10/1974 |
| DE | 102006003832 | 8/2007 |
| DE | 102009050584 | 4/2011 |
| DE | 102012015614 | 5/2014 |
| EP | 1710199 | 10/2006 |
| FR | 1423828 | 1/1966 |
| GB | 1153399 | 5/1969 |
| JP | 2000302379 | 10/2000 |
| JP | 5255884 | 8/2013 |

* cited by examiner

HOISTING WINCH ASSEMBLY

CROSS-REFERENCE TO RELATED APPLICATIONS

This application is a continuation of International Application No. PCT/EP2016/001060, filed Jun. 22, 2016, which claims priority to German Utility Model No. 20 2015 004 788.2, filed Jul. 3, 2015, and German Utility Model No. 20 2015 006 083.8, filed Aug. 28, 2015, all of which are incorporated by reference herein in their entireties.

BACKGROUND

1) Technical Field

The present invention relates to a hoisting winch assembly comprising at least two preferably axially parallel drums spaced from each other axially, which can be driven in synchronism with each other by two motors via a transmission assembly. The invention furthermore relates to a crane, in particular a gantry and/or container crane, with such hoisting winch assembly.

2) Description of the Related Art

The document DE 10 2009 050 584 A1 shows a container crane whose hoisting gear includes two axially parallel drums spaced from each other axially, i.e. in the direction of the longitudinal drum axis, which can be driven by a drive unit arranged centrally between the drums. This drive unit comprises a torque motor in the form of a multi-pole, permanently excited synchronous motor which drives the drums by means of cardan shafts, wherein in the drums transmissions are arranged, which are driven by the cardan shafts and reduce the motor speed. Such drive of the hoisting winches by a common motor ensures the synchronous run of the two drums, but only is used primarily for limited performance ranges, as a common motor otherwise cannot provide the performances required for both hoisting winches or would be dimensioned so large that the specified mounting dimensions and the specified axial spacing of the drums, which only provides a limited gap between the opposite end faces of the drums, might no longer be maintained. The position of the two cable drums to a large extent is defined by the fact that the usually four outgoing cables must be guided through existing openings in the steel construction with a predetermined deflection angle.

Although with a common drive motor, which drives both drums, an exact synchronous run of the drums can be achieved, it has therefore been proposed already to use two separate motors for driving the drums and to arrange the same beside the hoisting winches in order to be able to maintain the limited distance measure between the drums. The two cable drums here can be coupled with each other by a spur-gear transmission which can be arranged between the drums and can transmit the complete power of both motors for both drums. As the spur-gear transmission protrudes from the coaxial drums transversely to the same, the motors can be arranged beside the drums in a manner axially parallel to the drums. Due to the coupling of the drums by said spur-gear transmission it also is ensured that the drums rotate absolutely synchronously. In case of emergency, the system also can operate with only one of the two motors.

The motors arranged beside the drums however in turn lead to arrangement problems or constraints during installation, as the motors are to be arranged in a particular sector, so as not to collide with the cables running off. On the other hand, the assembly of the hoisting winch system is very expensive. The two drums, the spur-gear transmission, the two electric motors and the usually provided brakes each must be aligned individually and be fixed on the supporting structure. For this purpose, the bearing surfaces regularly spaced apart from each other several meters must exactly be machined mechanically in order to avoid alignment errors between the drum axes or alignment errors from the spur-gear transmission axes to the drum axes and the motor axes.

Proceeding therefrom, it is the object underlying the present invention to create an improved hoisting winch assembly and an improved crane with such hoisting winch assembly, which avoid disadvantages of the prior art and develop the latter in an advantageous way. In particular a compact, lightweight hoisting winch assembly is to be created, which is easy to mount and also can provide high performances with a favorable efficiency.

SUMMARY

According to the invention, said object is solved by hoisting winch assembly according to claim 1 and by a crane according to claim 16. Preferred aspects of the invention are subject-matter of the dependent claims.

It hence is proposed to no longer transmit the entire power of all motors via a common transmission by which the drums are coupled to each other, but to separately transmit the power of each motor to the drum associated with the respective motor. According to the invention, the transmission assembly has at least two separate gear trains, so that each motor is in drive connection with one drum each via a separate gear train. As compared to a common transmission to which both motors are connected, the separate gear trains can be configured significantly lighter and smaller, as no longer the power of both motors added up, but only the power of one motor must be transmitted. Nevertheless, high hoisting powers can be provided on the whole, as each motor must drive only one drum.

As compared to previously customary hoisting winch assemblies with two motors beside the drums, a significantly more compact and smaller construction can also be achieved. In particular, the two motors at least substantially can be arranged completely in a space between the drums, wherein this space can be defined by two imaginary planes which are arranged on the end faces of the drums facing each other vertically to the longitudinal drum axes. As compared to conventional drive architectures, it also is possible advantageously to provide less sealing points, less anti-friction bearings, less compensating couplings, significantly less lubricant and in view of all this a significantly lower weight.

To additionally gain space for the motor and gear train assembly between the drums, each gear train according to a development of the invention can comprise a drum transmission at least partly inserted into the respective drum. Such drum transmission at least partly accommodated in the interior space of the drum body at the same time can be utilized for bearing or supporting the drum, wherein a corresponding bearing integrated into said drum transmission can be configured as a radial and/or axial bearing. Advantageously, at least one anti-friction bearing in the drum transmission can support the drums on the supporting structure via the transmission housing.

The motors in various ways can be connected to the drums or to said drum transmissions inserted into the drums. In particular, a connection transmission can be provided between the respective drum transmission and the associated motor, which can be configured as a spur-gear transmission or as an angular transmission in order to be able to adapt the motor assembly to the conditions of the installation environment.

When the respective motor is connected to the associated drum or the drum transmission inserted therein with an angular transmission, the motor with its longitudinal motor axis can extend transversely to the longitudinal drum axis in one plane, whereby very narrow spacings of the drum end faces can be provided.

When the respective motor is connected to the drum or the drum transmission inserted therein by a spur-gear transmission, the motor can extend in a manner axially parallel to the drum with its longitudinal motor axis. An assembly radially constructed very small can be achieved thereby. When both motors are arranged axially parallel via such spur-gear transmissions, the motors advantageously can be arranged in different sectors, in particular on opposite sides of an imaginary plane containing the longitudinal drum axes, whereby a generally very flat hoisting winch assembly can be achieved. In particular, in said imaginary plane the extension of the hoisting winch assembly can substantially be determined by the diameter of the drums, as the motors arranged on opposite sides of said imaginary plane do not or hardly protrude beyond the drums, when viewing the hoisting winch assembly in a viewing direction vertically to the imaginary plane.

Depending on the structural conditions of the installation environment, mixed forms of the aforementioned motor alignments possibly can also be provided. For example, a motor can be arranged with its longitudinal motor axis transverse to the longitudinal drum axis via an angular transmission, while the motor associated with the other drum can be arranged axially parallel via a spur-gear transmission. Depending on the structural conditions, it can often be advantageous however to mount both motors axially parallel or both motors transversely to the longitudinal drum axis.

A brake for holding and/or braking the drum advantageously can be integrated into each of said gear trains between motor and drum, wherein the brake can be arranged between drum transmission and motor, in particular between drum transmission and connection transmission or between connection transmission and motor. For example, when using an angular transmission as connection transmission it can be advantageous to provide the brake between angular transmission and drive motor. When using a spur-gear transmission as connection transmission it can be advantageous to provide the brake between the spur-gear transmission and drum transmission, wherein here as well however the brake can be provided between spur-gear transmission and motor.

In particular, in a development of the invention a brake stator can be attached to a transmission housing portion. The brake can be configured as a disk brake, multidisk brake or drum brake. In a disk brake, a brake caliper can be attached to a transmission housing portion.

By said brake assembly not only a compact construction can be achieved, but the brake can also be dimensioned small and be protected from excessive loads, as due to the gear ratio of the gear train between brake and drum a larger drum torque can be compensated by a smaller braking torque.

To ensure a synchronous run of the two drums, the drums and/or the motors can be synchronized with each other by a sychronizing device. In a development of the invention, such synchronizing device can comprise an articulated shaft e.g. in the form of a cardan shaft which is provided between the drums. In particular, such articulated shaft can be connected to the two drum transmissions which are inserted into the two drums, wherein alternatively however a connection to the above-described connection transmissions in the form of the angular or spur-gear transmissions can also be provided. By such an articulated shaft not only an exact synchronous run of the two drums can be achieved, but also a compensation of an axial offset, which simplifies the assembly of the drums as regards positional tolerances.

Possibly, however, such synchronization shaft or articulated shaft between the drums or the drum transmissions can also be omitted. The synchronizing device also can be of the electronic type and effect an electronic synchronization of the motor run of the two motors, e.g. by a central control or processor unit which adjusts the drive pulses provided to the motors to each other and ensures a synchronous run of the motors.

To further facilitate mounting of the hoisting winch assembly, a modular construction of the hoisting winch assembly can be provided in a development of the invention, in which several assemblies are combined to premounted assembly units. In particular, a drum with the associated motor and the interposed gear train each can be combined to a premounted assembly unit or assembly, which as a whole can be mounted on a hoisting gear carrier or on the supporting structure. The drum and drive units thereby can be tested for the function of the drive already at the factory, and in addition merely two more assemblies need to be mounted on the steel construction of the crane or on the supporting structure, without an exact alignment of drum, transmission and motor relative to each other still being relevant. Between the drums as well at least minor alignment errors no longer are decisive, as the same are compensated by the articulated shaft or the electronic synchronization and do not disturb. In particular, the costly and expensive mechanical treatment of surfaces disposed far apart also can be avoided thereby.

In particular, it can be sufficient to attach each drum unit to the supporting structure via e.g. three, four or more bolt or form-fit connections. The two drum units also can be connected by said articulated shaft.

BRIEF DESCRIPTION OF THE DRAWINGS

The invention will subsequently be explained in detail with reference to preferred exemplary embodiments and associated drawings. In the drawings.

DETAILED DESCRIPTION

Figure 1:
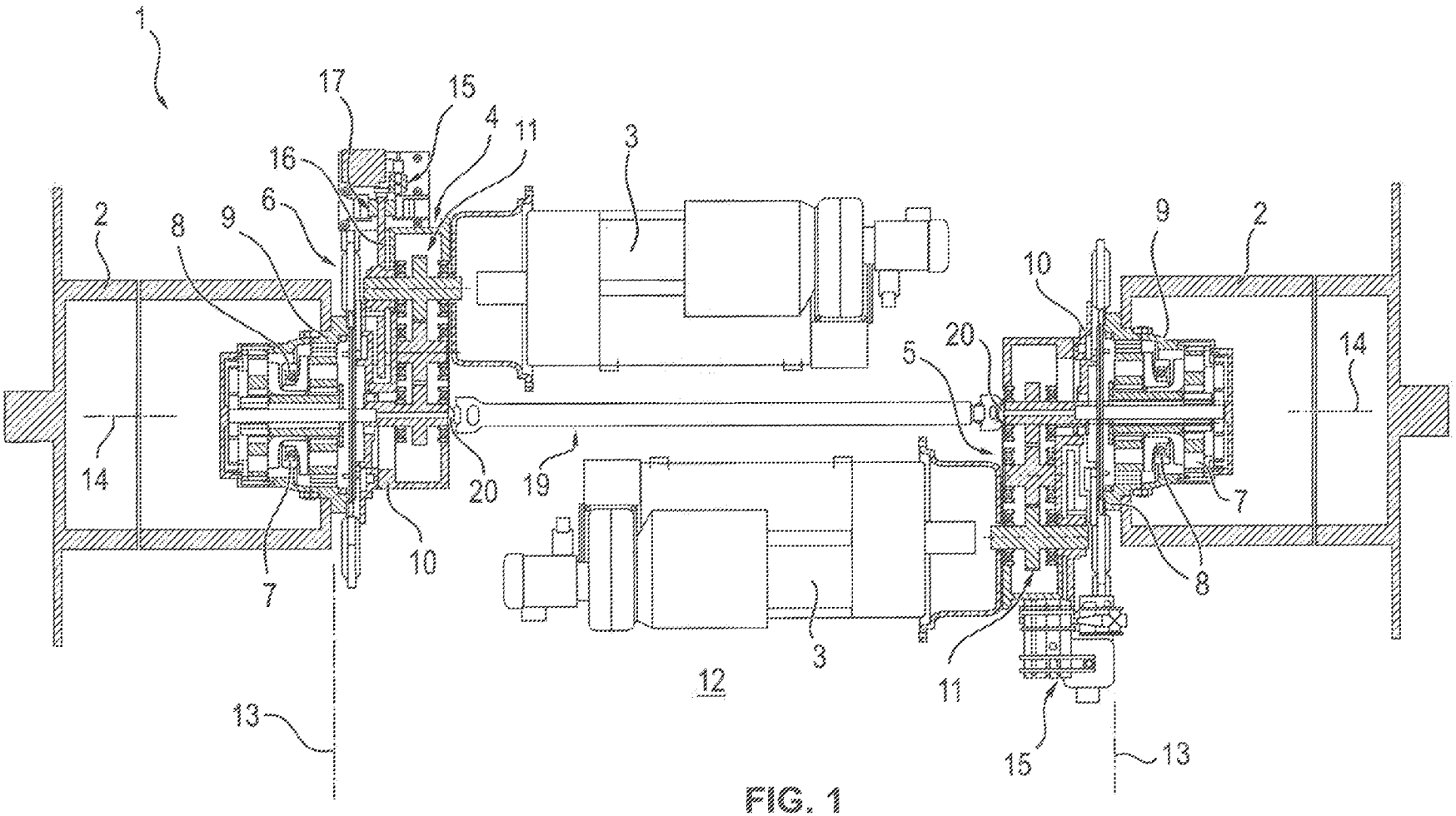
FIG. 1: shows a longitudinal section through a hoisting winch assembly according to an advantageous embodiment of the invention, according to which the two motors are arranged in an axially parallel manner and are connected to only one drum each via separate spur-gear transmissions.

As shown in the Figures, the hoisting winch assembly 1 comprises two axially parallel drums 2 spaced from each other, which as regards their basic structure can be configured in a manner customary per se, in particular can comprise a grooved drum body with flanged wheels. On end-face edge portions the drums 2 also can comprise non-grooved cylinder portions which form a reserve, if a longer cable is to be drawn up. In a manner known per se, two cables can run off from each drum 2, as can be the case for example in gantry or container cranes, in order to be able to stably lift and lower the hoisting harness for picking up containers.

As shown in the Figures, the drums 2 in particular can be arranged coaxially to each other.

Each of the drums 2 here is driven by a motor 3 which is in drive connection with only one drum each by a separate gear train 4 or 5 of a transmission assembly 6.

Figure 3:
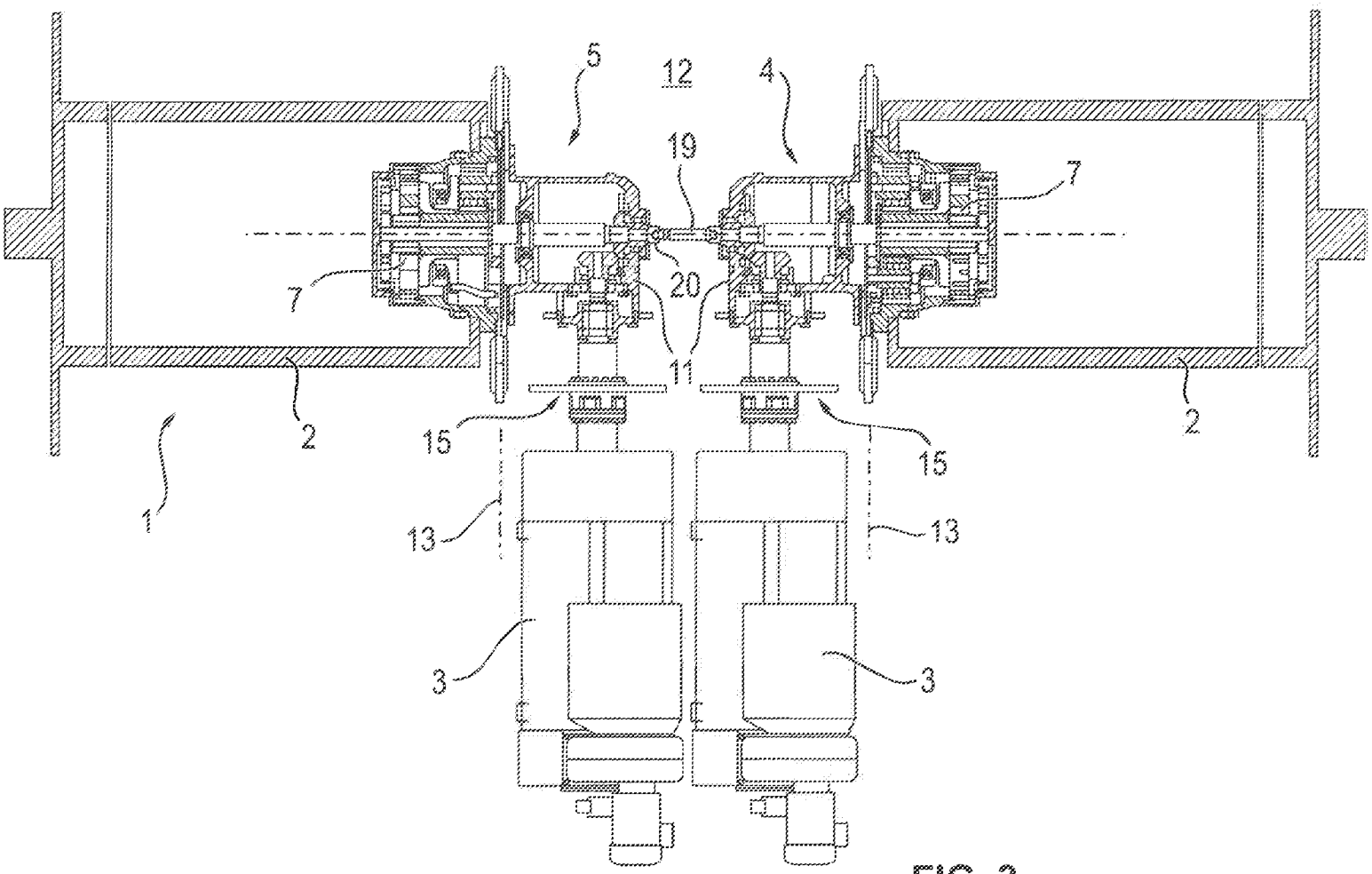
FIG. 3: shows a longitudinal section through a hoisting gear assembly according to another advantageous embodiment of the invention, according to which the motors with their longitudinal motor axes are arranged transversely to the longitudinal drum axes and are connected to one drum each via angular transmissions.

As shown in FIGS. 1 and 3, each of said gear trains 4 and 5 can comprise a drum transmission 7 which at least for the preferably larger part, in particular also substantially can completely be accommodated in the interior of the drum 2, so that on the end face only one connecting part or portion of the drum transmission 7 protrudes from the drum 2 and is accessible.

Into said drum transmissions 7 bearing units 8 e.g. in the form of one or more anti-friction bearings can be integrated in order to support the drum 2 at the drive-side end via the drum transmission 7. In particular an output bell 9 of the drum transmission 7, which can rigidly or non-rotatably be connected with, e.g. screwed to the drum 2, can rotatably be supported with respect to the standing transmission housing 10 via the bearing unit 8, which transmission housing in turn can be attached to the non-illustrated supporting structure which for example can be part of a crane.

As shown in FIG. 1, the motors 3 each can be connected to one of the drum transmissions 7 by means of a connection transmission 11, wherein said connection transmission 11, as shown in FIG. 1, can be configured as a spur-gear transmission which on the output side is connected with the input shaft of the drum transmission 7 and on the input side with the motor 3.

The motor 3 can be arranged axially parallel, but axially offset to the longitudinal drum axis of the associated drum 2, cf. FIG. 1.

As shown in FIG. 1, the two motors 3 thereby can both be arranged between the drums 2, namely in particular in a space 12 which is defined by two imaginary planes 13 which are arranged at the drive-side end faces of the drums 2 vertically to the longitudinal drum axis, cf. FIG. 1. Advantageously, the two motors 3 here can overlap, so that the motors 3 at least partly overlap in a viewing direction vertically to the longitudinal drum axis (which viewing direction in FIG. 1 lies in the drawing plane).

In particular, the motors 3 can be arranged on opposite sides of an imaginary plane which contains the longitudinal drum axis 14. The motors 3 at least are arranged in various sectors, i.e. angular ranges proceeding from the drum axis 14, so that despite said overlap the motors 3 do not collide with each other.

As shown in FIG. 1, a brake 15 advantageously can be integrated into each gear train 4 or 5, wherein said brake 15 for example can be integrated into the spur gear or connection transmission 11 and/or be arranged on the transmission axis coupled with the motor shaft and/or be coupled directly with the motor shaft. Said brake 15 in particular can be configured as a disk brake or multidisk brake, wherein a brake disk 16 can be seated on the transmission shaft coupled with the motor shaft. A brake stator for example in the form of a brake caliper 17 advantageously can be attached to the transmission housing of the connection transmission 11.

Figure 2:
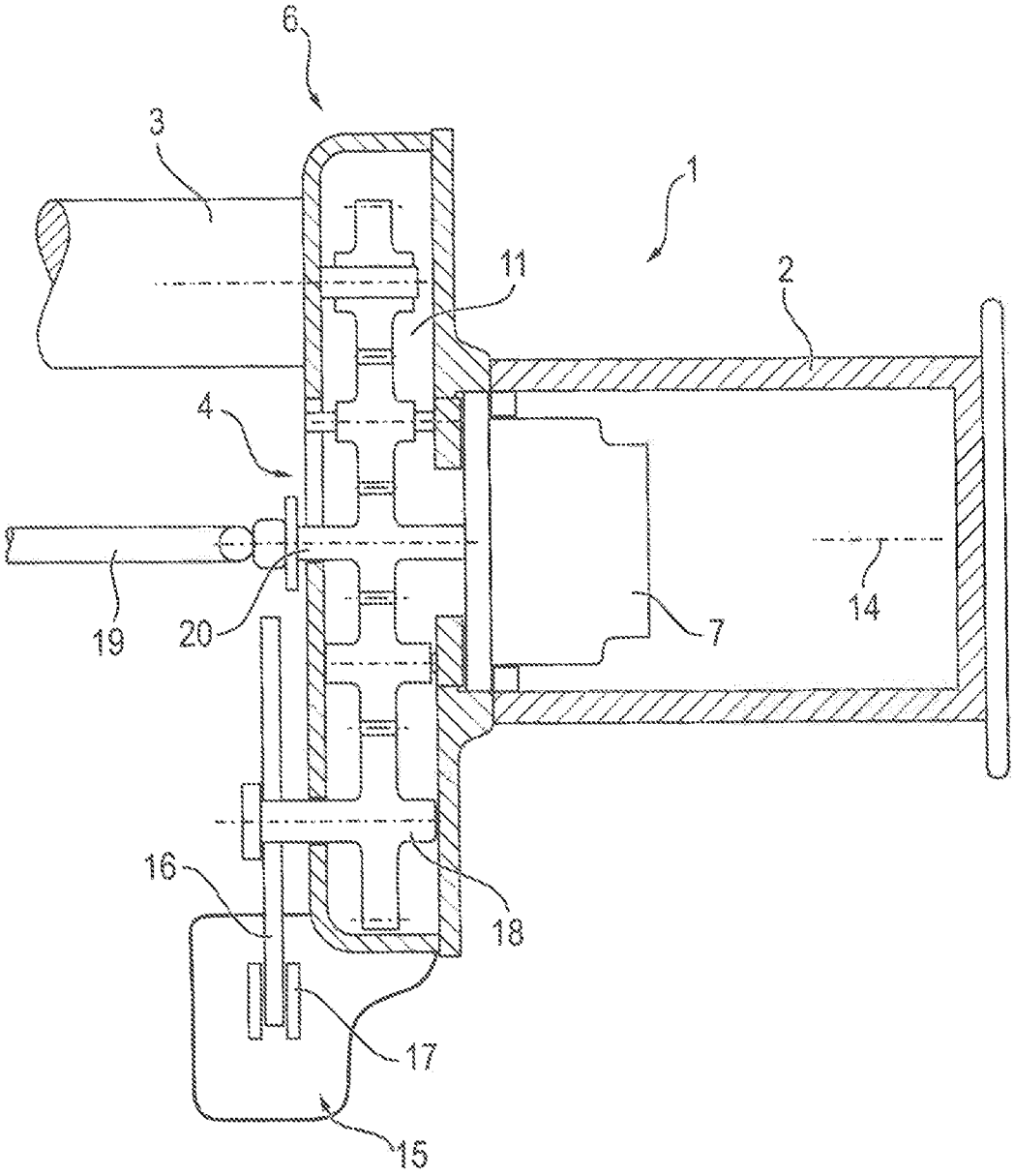
FIG. 2: shows a partial sectional view of a motor-transmission-drum unit similar to FIG. 1, wherein in contrast to the embodiment of FIG. 1 a brake is arranged on the opposite side of the motor which in turn is arranged on the spur-gear transmission in an axially parallel manner.

As shown in FIG. 2, said brake 15 however can also be connected or coupled with a transmission shaft 18 which is not directly connected with the motor shaft of the motor 3. For example, the brake 15 can be arranged on a side of the connection transmission 11 opposite the motor 3, whereby more space is available for the installation of the brake 15. Advantageously, the brake stator or the brake caliper 17 here can also be attached to the housing of the connection transmission 11, cf. FIG. 2.

As shown in the Figures, a synchronous run of the two drums 2 can be achieved by a synchronizing shaft despite the separate gear trains 4 and 5, which synchronizing shaft advantageously can be configured as an articulated shaft 19, in particular as a cardan shaft. Said synchronizing shaft advantageously can be arranged axially parallel or coaxially to the longitudinal drum axis 14 and be connected to the two drum transmissions 7 or to the two connection transmissions 11. The gear trains 4 and 5 therefor can each have an axle connection 20 which can be connected with the articulated shaft 19 and can protrude coaxially to the longitudinal drum axis 14 from the drive-side end face of the drums or the transmission assemblies provided there.

Figure 4:
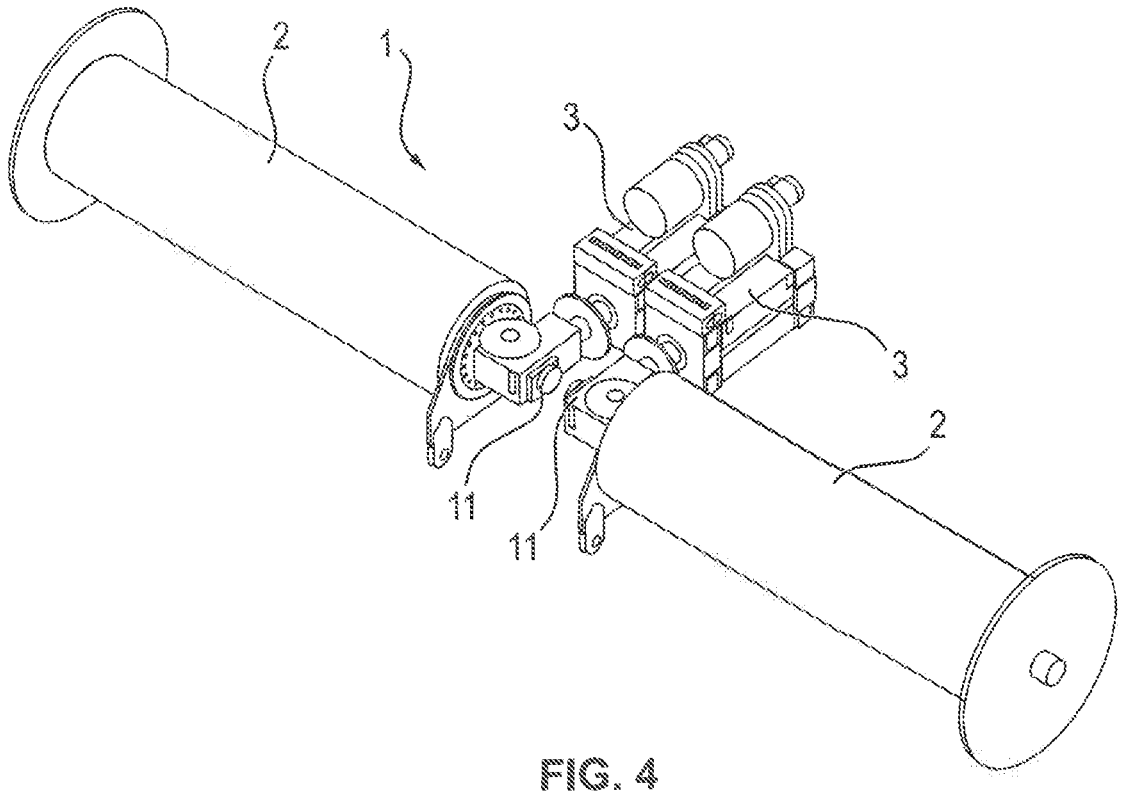
FIG. 4: shows a perspective representation of the hoisting winch assembly of FIG. 3.

As shown in FIG. 3, the motors 3 with their longitudinal motor axes also can be arranged in planes transverse to the longitudinal drum axis 14. The connection transmissions 11 here can be configured in the form of angular transmissions. The motors 3 can point to different sides, in particular however can also be aligned parallel to each other, as is shown in FIG. 4.

We claim:

1. A hoisting winch assembly comprising:

at least two drums configured to be jointly driven by at least two motors via at least one transmission assembly, each of the at least two drums having an interior, wherein the at least one transmission assembly comprises two separate gear trains, so that each of the at least two motors is in drive connection with one drum via at least one separate gear train, each of the at least one separate gear trains comprising a drum transmission and a connection transmission releasably mounted to each other and configured to allow for repositioning of each of the at least two motors, each drum transmission being at least partly in the interior of at least one of the at least two drums, wherein each drum transmission has a connection part protruding from at least one of the at least two drums, wherein each connection transmission is outside of the at least two drums, and wherein each connection transmission is connected to an input shaft of the corresponding drum transmission by the connection part.

2. The assembly of claim 1, wherein the at least two drums have longitudinal drum axes, wherein the at least two motors are arranged in a space between the at least two drums which is defined by planes which are arranged on the end faces of the at least two drums facing each other vertically to the longitudinal drum axes.

3. The assembly of claim 2, wherein the at least two motors have longitudinal motor axes, and wherein the longitudinal motor axes are arranged axially parallel to the longitudinal drum axes with an axial offset to said longitudinal drum axes in various angle sectors, wherein the various angle sectors comprise on opposite sides of a plane containing the longitudinal drum axes.

4. The assembly of claim 2, wherein the at least two motors have longitudinal motor axes, and wherein the longitudinal motor axes are arranged transversely to the longitudinal drum axes.

5. The assembly of claim 1, wherein the connection transmission is configured as a spur-gear transmission and the at least two motors are arranged in an axially parallel manner between the at least two drums.

6. The assembly of claim 1, wherein the connection transmission is configured as an angular transmission, and wherein the at least two motors have longitudinal motor axes, and wherein the at least two drums have longitudinal drum axes, and wherein the at least two motors have their longitudinal motor axes each arranged in a plane transverse to the longitudinal drum axis.

7. The assembly of claim 1, wherein at least one brake is each integrated in each of the gear trains between the at least two motors and the at least two drums.

8. The assembly of claim 7, wherein the at least one brake is arranged between the drum transmission and the at least two motors, and between the drum transmission and the connection transmission or between the connection transmission and the at least two motors.

9. The assembly of claim 7, wherein the brake is configured as a disk brake, multidisk brake or drum brake.

10. The assembly of claim 7, wherein the brake is configured as a disk brake, with a brake caliper being attached to a transmission housing portion.

11. The assembly of claim 1, wherein the at least two drums and the at least two motors are coupled with each other by a coupling device.

12. The assembly of claim 11, wherein the coupling device is configured as a synchronizing device to synchronize the at least two drums and/or the at least two motors with each other.

13. The assembly of claim 12, wherein the synchronizing device comprises an articulated shaft arranged between the at least two drums.

14. The assembly of claim 12, wherein the synchronizing device is electronic and comprises an electronic controller for actuating and electronically synchronizing the at least two motors.

15. The assembly of claim 1, wherein the assembly has a modular construction in which each of the at least two drums together with the associated motor and the interposed gear train forms a premounted, separate assembly unit configured to be mounted as a whole on a hoisting winch carrier.

16. The assembly of claim 1, wherein the at least two drums are arranged spaced from each other in an axially parallel manner.

17. A crane in the form of a container and/or gantry crane, comprising: the assembly of claim 1.

18. The assembly of claim 1, wherein each of the drum transmissions comprise being units, wherein the bearing units rotatably support an output bell with respect to a standing transmission housing.

19. A hoisting winch assembly comprising:

at least two drums configured to be jointly driven by at least two motors via at least one transmission assembly, wherein each of the at least two drums has an interior, wherein the at least one transmission assembly comprises two separate gear trains, wherein each of the at least two motors is in drive connection with one drum via at least one separate gear train, wherein the at least one separate gear train each comprise a drum transmission and a connection transmission releasably mounted to each other and configured to allow for repositioning of the at least two motors, wherein each drum transmission is at least partly in the interior of one of the at least two drums and rotatably supporting one of the at least two drums, wherein each drum transmission has a connection part protruding from one of the at least two drums and an output bell non-rotatably connected to the drum and a standing transmission housing, wherein the standing transmission housing rotatably supports the output bell via an anti-friction bearing unit, wherein the standing transmission housing is attached to a support structure standing outside of the least two drums, and wherein each connection transmission is outside of the at least two drums, each connection transmission being connected to an input shaft of the drum transmission by the connection part.

* * * * *